United States Patent [19]

Dugge

[11] 3,933,100

[45] Jan. 20, 1976

[54] HOPPER GATE ACTUATING MECHANISM

[75] Inventor: Richard H. Dugge, St. Louis, Mo.

[73] Assignee: ACF Industries, Incorporated, New York, N.Y.

[22] Filed: July 31, 1974

[21] Appl. No.: 493,209

[52] U.S. Cl. ..... 105/282P; 105/282 A; 105/305; 105/308 B

[51] Int. Cl.[2]... B61D 7/20; B61D 7/22; B61D 7/26; B61D 7/32

[58] Field of Search ..... 105/282 R, 282 P, 282 A, 105/305, 308

[56] References Cited

UNITED STATES PATENTS

| | | | |
|---|---|---|---|
| 2,750,074 | 6/1956 | Dorey | 105/282 P |
| 3,138,117 | 6/1964 | Dorey | 105/282 P |
| 3,387,570 | 6/1968 | Pulcrano et al. | 105/282 P |
| 3,397,654 | 8/1968 | Snyder | 105/305 |
| 3,779,172 | 12/1973 | Schipper et al. | 105/282 P |
| 3,826,203 | 7/1974 | Martin et al. | 105/282 P |

FOREIGN PATENTS OR APPLICATIONS

| | | | |
|---|---|---|---|
| 587,985 | 12/1959 | Canada | 105/282 A |

*Primary Examiner*—Robert G. Sheridan
*Assistant Examiner*—Howard Beltran
*Attorney, Agent, or Firm*—Henry W. Cummings

[57] ABSTRACT

This application discloses a sliding gate the top surface of which is tapered so that as it is closed the top surface will compress against a first elastomeric sealing means to eliminate lading leakage, and move away from the lading as the gate is opened, reducing the force required to open the gate. A cam assist mechanism is combined with the inclined gate to further reduce the required opening torque. The gate may be mounted on rollers, which also aid to reduce the opening force required. However, a low friction track may also be utilized to support the gate. In addition to the first elastomeric sealing means, a second elastomeric sealing means may be provided, preferably spring-loaded, at the back edge of the gate to close the gap between the gate and the second sealing means when the gate is opened.

The gate may be fabricated from metal plates or utilize a honeycomb sandwich type of construction. The gate may be fabricated so that a rack which is part of the drive mechanism for the gate is imbedded in the honeycomb core so that the outer surface of the rack is flush with the bottom edge of the gate.

14 Claims, 14 Drawing Figures

HOPPER GATE ACTUATING MECHANISM

BACKGROUND OF THE INVENTION

Sliding gate gravity outlets have been used on covered hopper cars for many years. However, it often occurs that these outlets are very difficult to open. Gravity outlets also have caused problems due to leakage of lading, both while the cars are in transit and while they are being unloaded. The AAR has recently proposed a specification which will require that future gravity outlets have improved leakage characteristics and greatly reduced torque requirements to open the gates (not more than 400 foot pounds). It is most preferred that the torque required be even less, not more than about 300 foot pounds.

The methods presently used to lower the opening torque include various types of gear drives. If gearing is used to reduce the required opening torque, the angular shaft rotation required per inch of gate travel is increased throughout the entire travel of the gate an amount equal to the ratio in the gear system.

It is an object of the present invention to provide a gravity outlet in which the force required to open the gate is reduced.

Another object of the present invention is to provide an assembly for reducing the torque required to open the gate which does not increase the angular shaft rotation required throughout the entire gate travel from closed to open position.

Another object of the present invention is to provide a substantially leak-tight closure for the bottom of the hopper.

Other objects will be apparent from the following description and drawings.

THE DRAWINGS

SUMMARY OF THE INVENTION

This invention comprises a sliding gate, the top surface of which is tapered so that as it is closed the top surface will compress against a first elastomeric sealing means to reduce or eliminate lading leakage, and move away from the lading as the gate is opened reducing the force required to open the gate. A cam assist operating mechanism is combined with the inclined gate to further reduce the initial torque required to start the gate moving from open to closed position. The gate may be mounted on rollers, which also aid to reduce the opening force required. However, a low friction track may also be utilized to support the gate.

The first elastomeric sealing means may comprise a lip which is oriented so that the lading pressure will force it against the gate, providing additional sealing. A second elastomeric sealing means may be provided, preferably spring-loaded, at the back edge of the gate to close the gap between the gate and the second sealing means when the gate is opened, which is created due to the taper of the gate when it is opened.

The gate may be fabricated from metal plates or utilize a honeycomb sandwich type of construction. The honeycomb structure may comprise a metal skin on the top, bottom and sides, bonded to a honeycomb core. The gate may be fabricated so that a rack which is part of the drive mechanism for the gate is imbedded in the honeycomb core so that the outer surface of the rack is flush with the bottom edge of the gate.

DETAILED DESCRIPTION

Figure 1A:
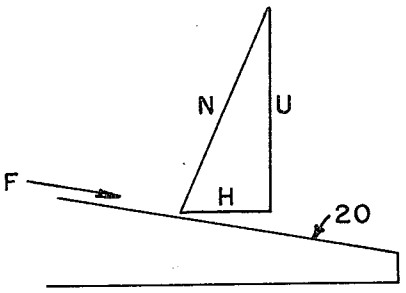
FIG. 1A is schematic representation of the lading "lodging" and the lading frictional force applied to an inclined gate.
Figure 1:
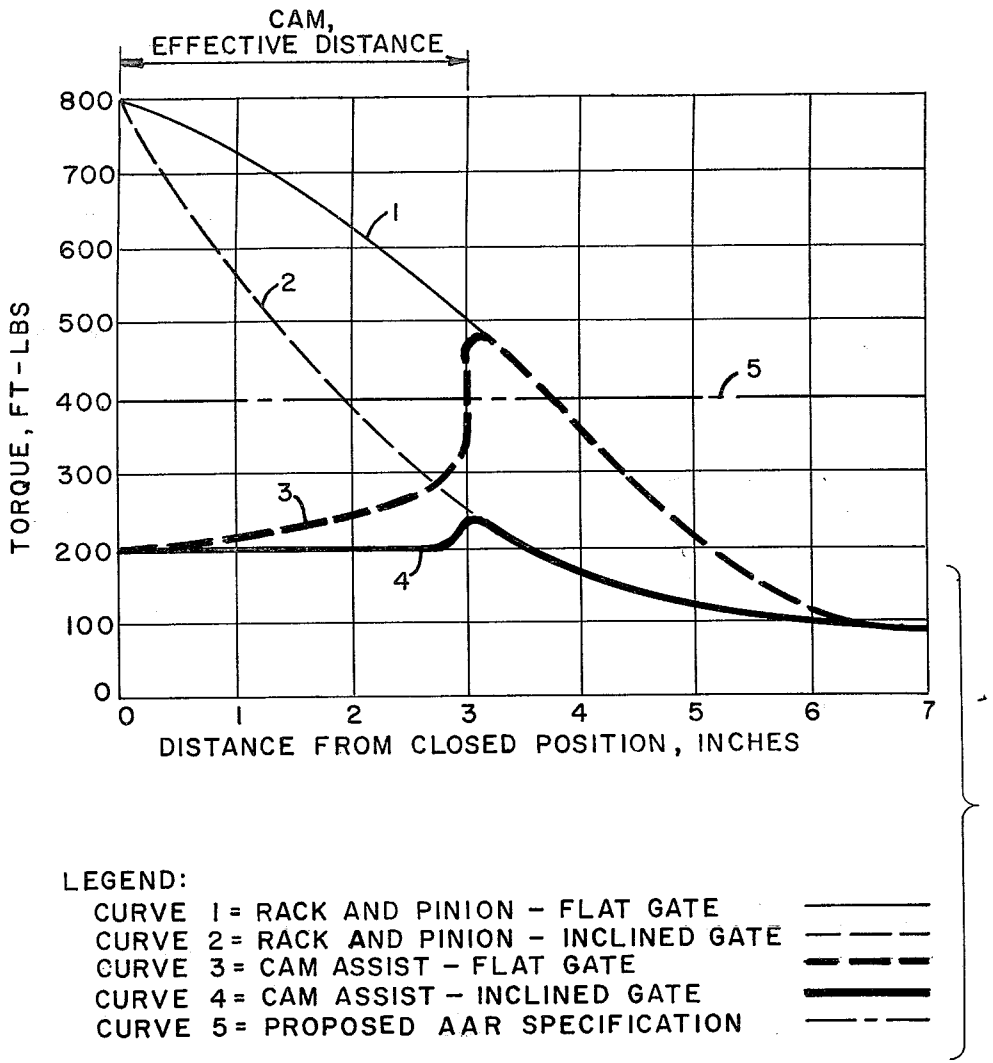
FIG. 1 is a plot of the torque required to move a gravity outlet against the distance the outlet moves from the closed to open position.

The opening force or rotational torque required to open the gate in a gravity outlet when the hopper is loaded, as shown in FIG. 1, is maximum just as the gate starts to move. However, after the gate starts to move, the required torque to keep the gate moving toward a fully open position is reduced. In the case of a flat gate, the decrease in opening force is rather gradual (Curve No. 1). In the case of an inclined or wedge-shaped gate (Curve No. 2) the opening force drops off much more rapidly.

It can also be seen from FIG. 1, if a flat gate is initially opened with a cam having a mechanical advantage, for example, as disclosed and claimed in U.S. Pat. Nos. 3,387,570 and 3,397,654, the required torque is much less (Curve No. 3). Curve No. 4 shows the torque required when a mechanical advantage cam assist is combined with an inclined gate. Comparison of Curves 3 and 4 reveals that after the cam assist is no longer operative to reduce the torque required to open the gate, the inclined gate continues to reduce the torque required to open the gate. After the cam has opened the gate the first few inches, the gate can then be opened the remaining amount with a conventional rack and pinion arrangement. Curve 5 shows the proposed AAR maximum allowable torque.

Figure 2:
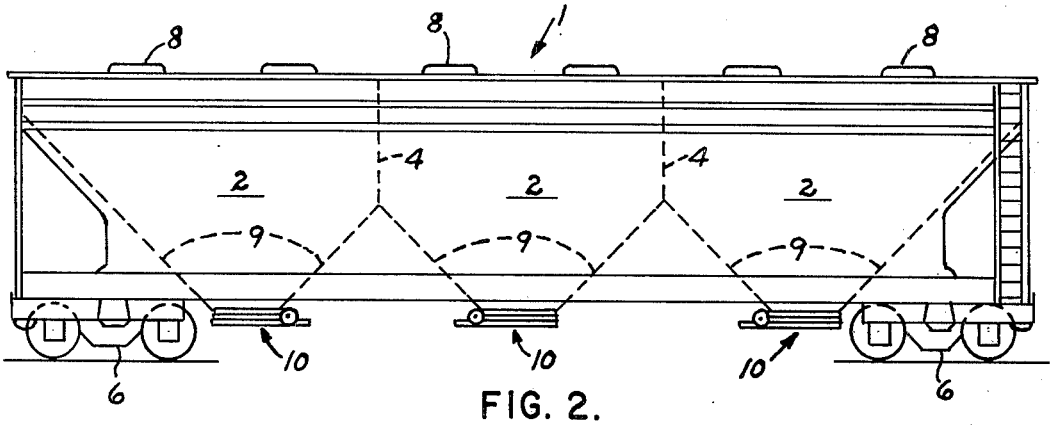
FIG. 2 is a side elevation of a covered hopper railway car having a plurality of bottom outlet structures comprising the present invention.

Referring to FIG. 2, a covered hopper railway car is generally designated 1 and has a plurality of hoppers 2 separated by partitions or bulkheads 4. A truck assembly 6 is arranged at each end of car 1. Spaced along the top of car 1 are hatch covers 8 for loading of the car with finely-divided materials, such as corn, wheat, granulated potash. Hopper sheets 9 of each hopper structure 2 slope downwardly to a bottom discharge opening defined by outer peripheral flanges 7.

Figure 3:
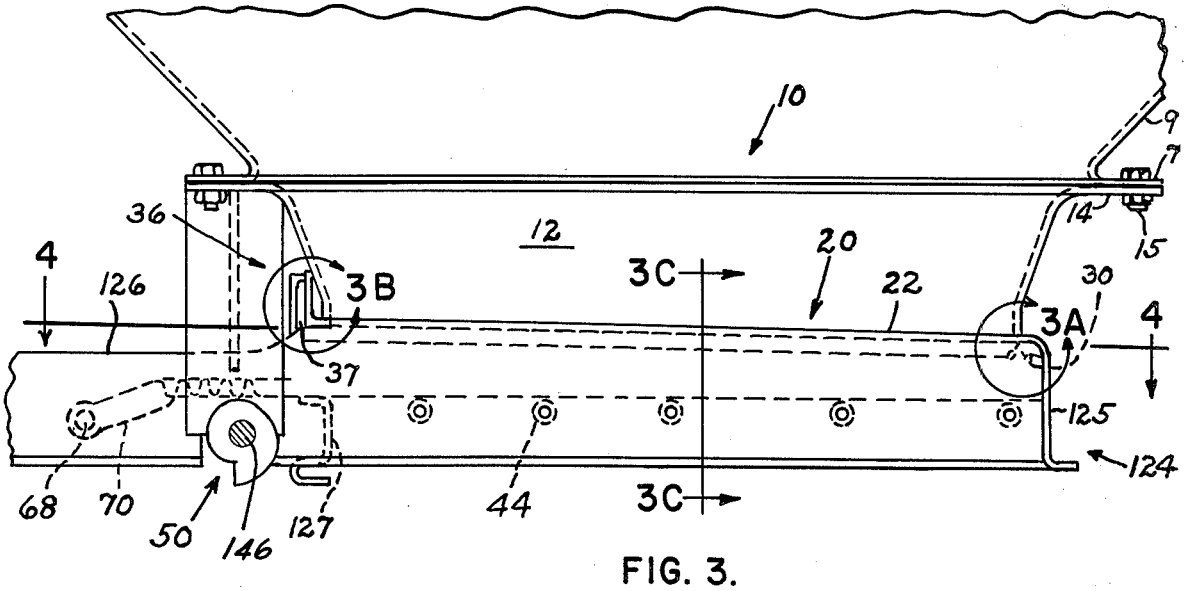
FIG. 3 is a side elevational view of the gravity outlet of the present invention.
Figure 4:
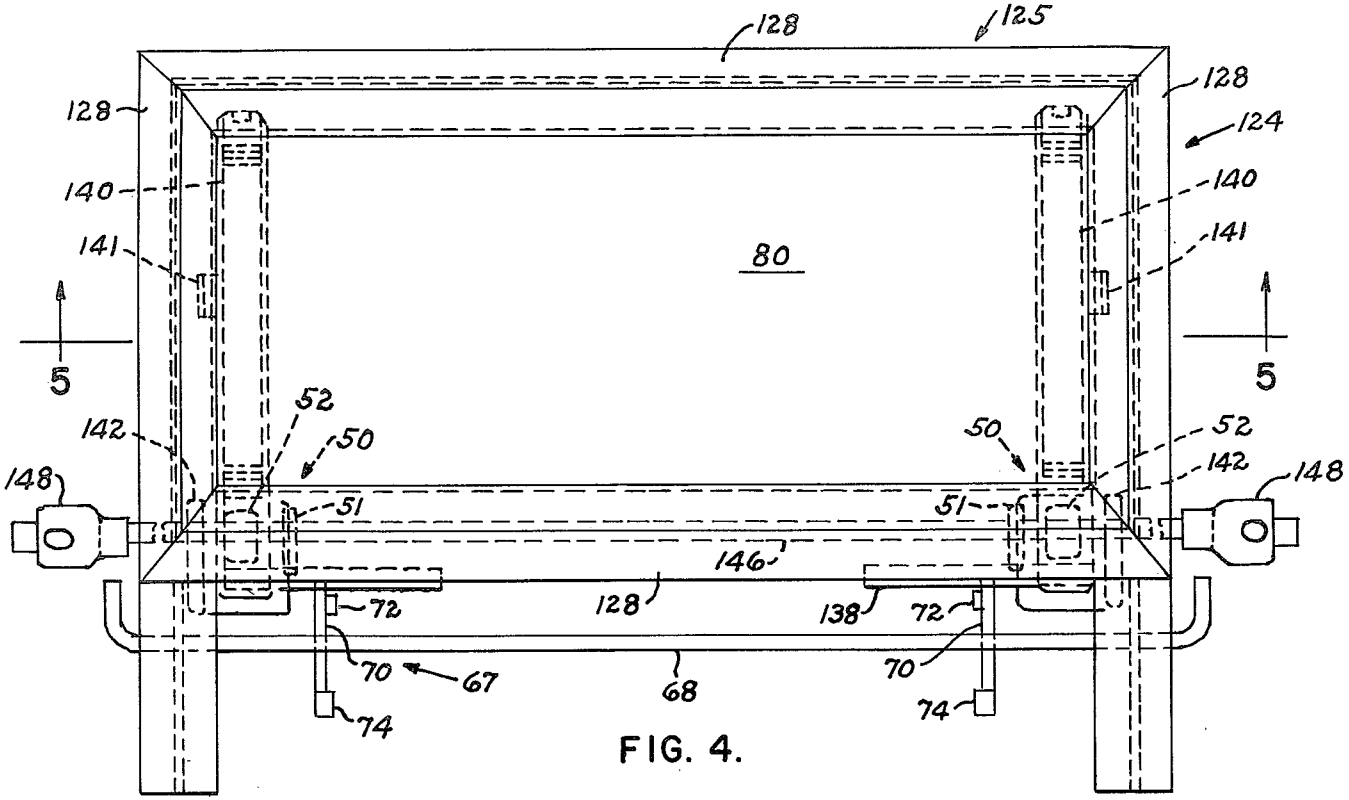
FIG. 4 is a top view of the gravity outlet of the present invention along the lines 4—4 in FIG. 3.
Figure 5:
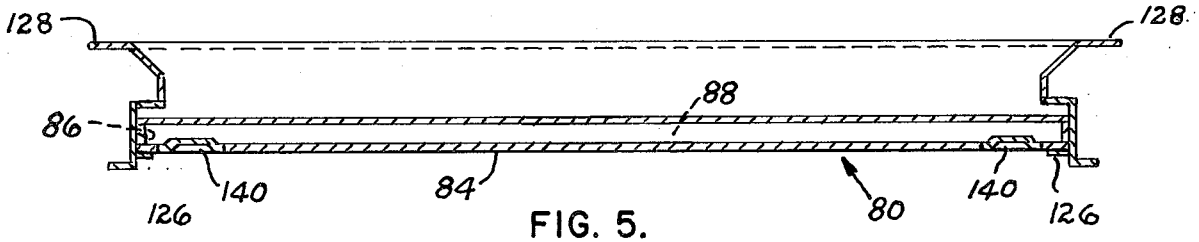
FIG. 5 is a section taken generally along line 5—5 of FIG. 4.
Figure 6:
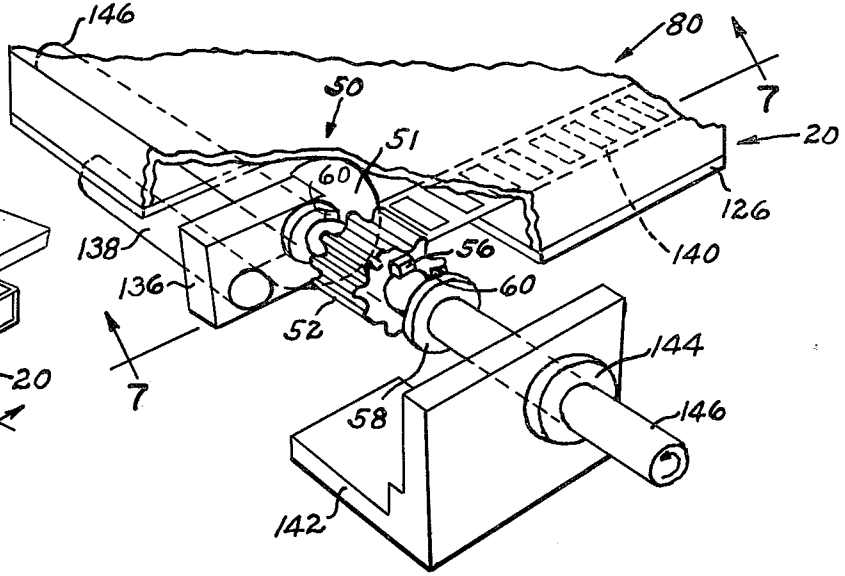
FIG. 6 is an exploded perspective of the cam assist mechanism for opening the sliding gate.

Referring to FIGS. 3–5 of the drawings, the outlet 10 may comprise a pan 12 having a flange 14 for removably affixing the outlet to flanges 7 of hoppers 2 with fasteners 15.

Secured to peripheral flange 7 beneath each bottom discharge opening is a frame structure generally indicated generally at 124. Each frame structure 124 comprises an end member 125 having an upper generally rectangular peripheral flange 128 and a front support 127, for example, of channel shape. The gate is supported on the sides with low friction track side support members 126.

The sliding gate 20 may comprise a fabricated or cast plate or be fabricated utilizing a honeycomb sandwich type of construction described hereinafter.

Figure 3B:
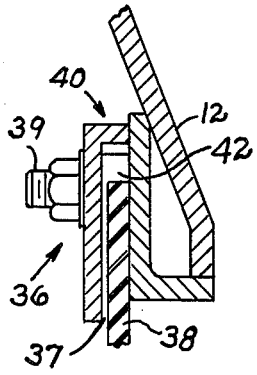
FIG. 3B is a detailed view of the second elastomeric sealing means.

The top surface 22 of the gate is tapered so that as the gate is closed the top surface 22 will compress against a first sealing means indicated generally at 30 to reduce or eliminate lading leakage. Sealing means 30 may comprise an elastomer 31 which may be bonded to pan 12 or be removably affixed with fasteners 34. In addition to the seal created from compression of the elastomer 31, as shown in FIG. 3A, a lip 32 may be provided which is oriented so that the lading pressure will force it against the gate, providing additional sealing. As the inclined gate is opened, it moves downwardly, away from the lading, reducing the force or torque required to open the gate. Furthermore, many ladings tend to bind together or "bridge". It is believed that after the inclined gate moves downwardly, away from the lading, many ladings tend to "bridge" and thus become self sustaining. Since the frictional force (F) acting upon the gate is equal to U N, where U is the coefficient of friction between the lading and the gate and N is the normal force, if the lading "bridges" and becomes self-sustaining (supported by the hopper slope from the side) the force required to open the gate is less due to the reduction in the normal force. Also the force N which is normal to the inclined gate has a component H which is horizontal and in the direction to aid in opening the gate as shown in FIG. 1A. Thus the inclined gate reduces the force or torque required to open the gate due to bridging and due to the horizontal component of the lading force which is normal to the inclined gate. Preferably the gate is inclined 2° to 15° to the horizonal.

In addition to first sealing means 30 a second sealing means 36 may be provided at the back edge of the gate to close the gap 37 between the gate and the seal when the gate is opened, which is created due to the taper of the gate when it is opened. As shown in FIG. 3B, second sealing means 36 may comprise an elastomeric sealing strip 38 held in place with fasteners 39 which is preferably resiliently biased with resilient means 40, for example, by means of spring 42.

Figure 3C:
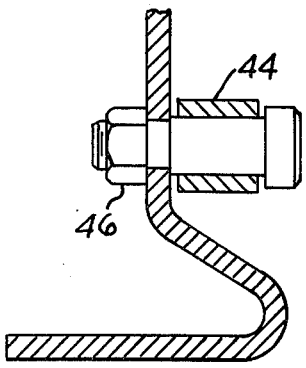
FIG. 3C is a sectional view along the lines 3C—3C in FIG. 3.
Figure 3A:
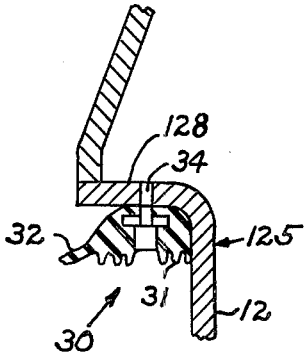
FIG. 3A is an enlarged detailed view of the first elastomeric sealing means.

The gate may be mounted on rollers 44 affixed to the outlet frame structure with fasteners 46 (FIG. 3C). The rollers aid to reduce the opening force required. If the gate is supported on rollers, the outlet structure is contoured so that there are no ledges or protrusions which will permit lading to hang up. Alternatively, the gate may be mounted on a low friction track as shown in FIG. 5 at 126.

An important feature of the present invention is the combination of the inclined gate 20 with a cam assist indicated generally at 50.

The cam assist arrangement may be as described in ACF U.S. Pat. Nos. 3,387,570 and 3,397,654 hereby incorporated into the present application by this reference, where cams are used to open flat gates. The preferred arrangement is disclosed in U.S. Pat. No. 3,387,570, which will be described as an example.

Secured to opposed side edges of gate 20 are blocks 136 supported on the upper surface of low friction truck 126 and adapted to move therealong with gate 20. Stub shafts 138 may be secured to gate 20 and blocks 136. Mounted for pivotal movement on the outer end of each stub shaft 138 is a rack 140 provided for sliding movement with gate 20 along the upper surface of the subjacent end track member 126. A rack retainer slip 141 may be provided and if so, secured to each end track member 126 to guide the associated rack 140 as shown in FIGS. 4 and 5.

A bearing support bracket 142 is secured to the underside of each end track member 126 and has a bearing 144 thereon. A pinion shaft 146 is mounted in bearings 144 for rotation and has a capstan 148 fixed to each end thereof. A suitable handspike (not shown) or the like may be inserted in suitable openings of capstans 148, or if desired, a suitable source of rotational power (not shown) affixed to capstan 148 to rotate shaft 146 for opening and closing gate 20.

Figure 7:
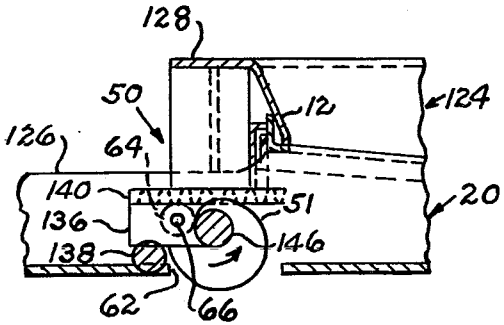
FIG. 7 is a section taken generally along line 7—7 of FIG. 6 and illustrates the cam mechanism for initially breaking the gate open with the gate in fully closed position.

To provide a mechanical advantage and a relatively high force for initially opening gate 20, the present invention comprises a cam 51 fixed to pinion shaft 146 adjacent each side thereof and acting against an adjacent block 136. A pinion 52 adjacent each end of shaft 146 is mounted for free rotation on shaft 146 and has a pair of lugs 56 extending therefrom. Fixed to shaft 146 are drive rings 58 each having a lug 60 adapted to engage an associated lug 56 for driving the adjacent pinion 52. As shown in FIG. 7, an opening 62 in the horizontal leg of each side member 26 beneath cam 51 receives cam 50 upon rotation thereof. Positioned adjacent cam 51 on each block 136 is a roller 64 mounted on an axle 66 for rotation and in engagement with cam 51 for minimizing frictional contact between cam 51 and block 36.

Means 67 are provided to secure gate 20 in closed position. For example, a latch rod 68 is mounted for rotation on track members 126 and has latch bars 70 thereon adapted to swing behind an adjacent stub shaft when gate 20 is in closed position to prevent opening of the gate. Latch bars 70 are supported on tabs 72 in the closed position of the gate indicated in FIG. 4 and on tabs 74 in the open position of gate 20 shown in FIG. 4.

Figure 8:
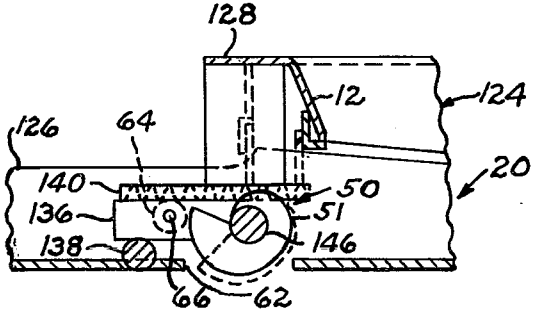
FIG. 8 is a section similar to FIG. 7 but illustrating the gate and cam mechanism after the gate has been initially opened by the cam mechanism.

For initially opening gate 20 from the fully closed position shown in FIG. 4, latch rod 68 is rotated to the position of FIG. 8 and pinion shaft 146 is rotated manually by a suitable handspike in capstan 148 or by a suitable rotational power source from either side of gate 20.

Initial rotation of shaft 146 rotates cams 51 in a counterclockwise direction as viewed in FIG. 7. Cams 51 are in engagement with rollers 64 and urge blocks 136 outwardly to move gate 20 in an opening direction. Pinions 52 since mounted for free rotation on shaft 146, are rotated by the movement of racks 140 upon the initial opening of gate 20 with the rotational movement of pinions 52 equal to the linear movement of gate 20. Upon rotation of cams 51 around 350° as shown in solid lines in FIG. 8, gate 20 opens a distance of around 2 inches. The outer circumferences of pinions 52 are rotated a distance of 2 inches by racks 140 upon the initial opening of gate 20 by cams 51 and thus, lugs 56 on pinions 52 are moved around 45° from their initial position shown in FIG. 7 to the position of FIG. 8 in which lugs 60 engage lugs 56 in driving relation. The position of cams 51 when pinions 52 are engaged by drive lugs 60 is indicated in broken lines in FIGS. 8 and thereafter, gate 20 opens at a relatively high rate of speed as cams 51 are out of engagement with rollers 64. The mechanical advantage of cams 51 may vary as desired, for as low as 2 to 1 up to 20 to 1 or higher so a large opening force is obtained for initially breaking gate 20 open.

When the gate 20 is fully opened and it is desired to move the gate toward a closed position, shaft 146 is rotated in an opposite direction and lugs 60 then engage the opposite side of lugs 56 to drive pinion 52 and to move gate 20 toward closed position.

When gate 20 reaches its remaining 2 inches of movement, lugs 60 and cams 51 are positioned so that cams 51 will be rotated into the position of FIG. 7 upon the full closing of gate 20. Thus, the positioning and dimensions of lugs 56 and 60 are such that cams 51 move into the position of FIG. 7 upon the full closing of gate 20. Therefore, when gate 20 is fully closed, cams 51 are in proper position for again opening gate 20.

Figure 9:
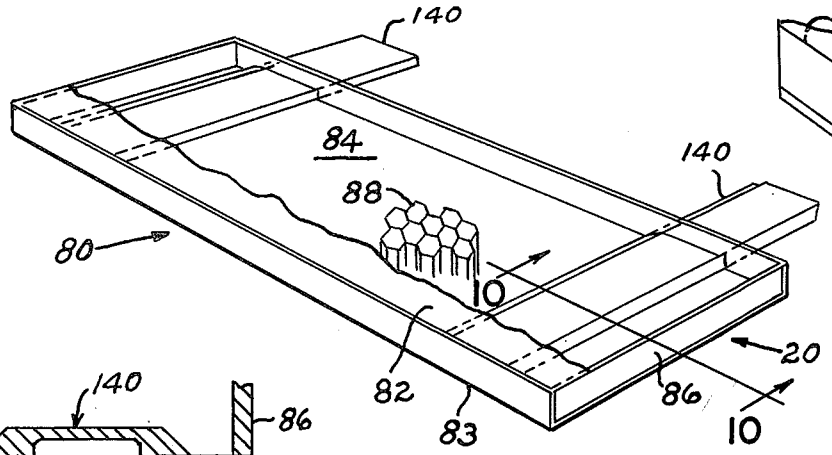
FIG. 9 is a perspective view illustrating the honeycomb structure that may be utilized for fabrication of the gate according to one embodiment of the present invention.
Figure 10:
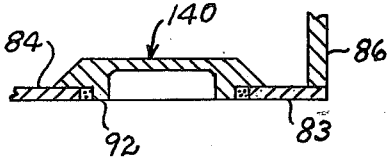
FIG. 10 is a sectional view along the lines 10—10 in FIG. 9.

If desired, as shown in FIGS. 9 and 10, the gate may comprise a honeycomb structure indicated generally at 80. The honeycomb structure may comprise metal sheets on the top 82, bottom 84 and sides 86 bonded to a honeycomb core 88. One or more racks 140 for the gate drive mechanism may be imbedded in the honeycomb core so that the outer surface 92 of the rack is substantially flush with the bottom edge 83 of the gate.

What is claimed is:

1. A gravity outlet comprising:

a pan having flange means for attachment to a hopper and sides inclined inwardly and downwardly to define an opening for lading discharge;

a gate movable horizontally between a closed position wherein said gate closes said opening and an open position wherein lading may discharge through said opening;

said gate having an upper surface which is inclined downwardly toward said first side acting to reduce the torque required to open said gate by moving away from the lading as the gate opens;

means for moving said gate horizontally between said open and closed positions comprising cam means for initiating movement of said gate from said first side, and drive means separate from said cam means for moving said gate to a desired open position and for moving said gate to closed position;

said cam means and said inclined upper surface acting together to effect a reduction in the starting torque required to open the gate until said cam means is no longer operative to reduce the torque required to open said gate, after which said inclined upper surface continues to reduce the torque required to open the gate.

2. A gravity outlet according to claim 1 wherein sealing means are provided on at least one side of said outlet, and wherein said sealing means close the gap created by said inclined surface when the gate is opened.

3. A gravity outlet according to claim 1 wherein said gate comprises a plate.

4. A gravity outlet according to claim 1 wherein said drive means comprises at least one rack and at least one pinion engageable therewith.

5. A gravity outlet according to claim 1 wherein a low friction track is mounted on said outlet which track supports said gate as it is moved between open and closed positions.

6. A gravity outlet comprising:

a pan having flange means for attachment to a hopper and sides inclined inwardly and downwardly to define an opening for lading discharge;

a gate movable horizontally between a closed position wherein said gate closes said opening and an open position wherein lading may discharge through said opening; said gate in closed position engaging first sealing means mounted on a first side of said outlet; said gate having an upper surface which is inclined downwardly toward said first side acting to reduce the torque required to open said gate by moving away from the lading as the gate opens;

resiliently biased second sealing means provided in said outlet on a second side opposite to said first side for closing the gap created by the inclined surface when said gate is opened;

means for moving said gate horizontally between said open and closed positions comprising cam means for initiating movement of said gate from said first side, and drive means separate from said cam means for moving said gate to a desired open position and for moving said gate to closed position;

said cam means and said inclined upper surface acting together to effect a reduction in the starting torque required to open the gate until said cam means is no longer operative to reduce the torque required to open said gate, after which said inclined upper surface continues to reduce the torque required to open the gate.

7. A gravity outlet according to claim 6 wherein said first sealing means comprises a lip which is engaged by said gate in closed position.

8. A gravity outlet according to claim 6 wherein rollers are mounted upon said outlet which support said gate as it is moved between open and closed positions.

9. A gravity outlet according to claim 6 wherein said second sealing means comprises an elastomeric strip.

10. A gravity outlet according to claim 9 wherein said elastomeric strip is spring loaded.

11. A gravity outlet comprising:

a pan having flange means for attachment to a hopper and sides inclined inwardly and downwardly to define an opening for lading discharge;

a gate comprising a honeycomb sandwich movable between a closed position wherein said gate closes said opening and an open position wherein lading may discharge through said opening; said gate in closed position engaging first sealing means mounted on a first side of said outlet; said gate having an upper surface which is inclined downwardly toward said first side;

resiliently biased second sealing means provided in said outlet for closing the gap created by the inclined surface when said gate is opened;

means for moving said gate between said open and closed positions comprising cam means for initiating movement of said gate from said first side; and drive means separate from said cam means for moving said gate to a desired open position and for moving said gate to closed position.

12. A gravity outlet according to claim 11 wherein said drive means comprises at least one rack and at least one pinion engageable therewith and wherein said rack is imbedded in said honeycomb sandwich.

13. A gravity outlet according to claim 12 wherein said rack is substantially flush with the bottom surface of the gate.

14. A gravity outlet comprising:

a pan having flange means for attachment to a hopper and sides inclined inwardly and downwardly to define an opening for lading discharge;

a gate movable on rollers between a closed position wherein said gate closes said opening and an open position wherein lading may discharge through said openings; said gate in closed position engaging first sealing means mounted on a first side of said outlet said gate comprising a honeycomb sandwich having an upper surface which is inclined downwardly toward said first side;

resiliently biased second sealing means provided in said outlet for closing the gap created by the inclined surface when said gate is opened;

means for moving said gate between said open and closed positions comprising cam means for initiating movement of said gate from said first side;

and drive means separate from said cam means for moving said gate to a desired open position and for moving said gate to closed position, said drive means comprising at least one rack and at least one pinion engageable therewith and wherein said rack is imbedded in each honeycomb sandwich.

* * * * *